United States Patent [19]

Fitch et al.

[11] 4,153,532

[45] May 8, 1979

[54] APPARATUS FOR DISASSEMBLY OF A PLURAL CELL ELECTROLYZER

[75] Inventors: Robert H. Fitch, Syracuse; Bruce E. Kurtz, Marcellus, both of N.Y.; Noel Y. Rothmayer, Madison, N.J.

[73] Assignee: Allied Chemical Corporation, Morristown, N.J.

[21] Appl. No.: 866,156

[22] Filed: Dec. 30, 1977

[51] Int. Cl.[2] ..... C25B 9/00; B66F 3/24

[52] U.S. Cl. ..... 204/267; 204/253; 254/93 HP

[58] Field of Search ..... 204/254–256, 204/253, 257, 258, 225, 266–267; 254/93 HP

[56] References Cited

U.S. PATENT DOCUMENTS

| | | | |
|---|---|---|---|
| 626,972 | 6/1899 | Craney | 204/225 X |
| 2,610,824 | 9/1952 | Grier | 254/93 HP |
| 3,174,722 | 3/1965 | Alm | 254/93 HP |
| 3,799,504 | 3/1974 | Vaughen | 254/93 HP |
| 3,930,978 | 1/1976 | Strewe et al. | 204/267 X |
| 4,064,032 | 12/1977 | Bouy et al. | 204/286 X |

*Primary Examiner*—Howard S. Williams
*Assistant Examiner*—D. R. Valentine
*Attorney, Agent, or Firm*—Anthony J. Stewart; Gerard P. Rooney

[57] ABSTRACT

A cell frame transfer cart for vertical and horizontal displacement of a segment of a plural cell electrolyzer is comprised of spaced main and secondary platforms, a vertical displacement member disposed intermediate the platforms, and a support member for supporting the main platform and permitting horizontal displacement of a selected segment of a plural cell electrolyzer when the vertical displacement member is actuated. An assembly including the present transfer cart, and a method for disassembly of a plural cell electrolyzer, are also described.

8 Claims, 6 Drawing Figures

10
12
12'
15
16
18
20
22
24
40
46
48
60
62
64
66
70
72
74
76
78
80
90
92
94
2.
3.

APPARATUS FOR DISASSEMBLY OF A PLURAL CELL ELECTROLYZER

BACKGROUND OF THE INVENTION

1. Field of the Invention

The present invention relates to a method and apparatus for the disassembly of a selected portion of a plural cell electrolyzer. More specifically, the present invention relates to a cell frame transfer cart, an assembly, and the associated method, for the removal of internal cell components of a plural cell electrolyzer.

2. Description of the Prior Art

The electrolysis of various fluid media is well known, and widespread. For example, the electrolysis of sodium chloride brine is by far the most important commercial process for producing chlorine and caustic soda, which electrolysis products are extensively employed in numerous other applications. Recently, there has been a tremendous interest exhibited in electrolysis cells incorporating permselective membranes which restrict gross hydraulic flow between compartments in such an electrolyzer. Because the membranes, typically cationic permselective membranes of a perfluorinated organic polymer matrix having ionogenic sulfonate groups attached thereto, preclude the flow of liquid while permitting, e.g., current-carrying sodium ions to pass, it is now possible to produce caustic soda of a predetermined concentration and nearly free from unwanted chlorides.

To obtain maximum utility from these cells incorporating permselective membranes, a multi-cell electrolyzer is conventionally employed. In this plural cell design, a number of semi-independent cells are arranged in serial fashion and provided with various means for permitting flow of the fluid medium to be electrolyzed, as well as means for electrical communication between and among the various cells comprising the electrolyzer. However, certain problems are attendant the use of multi-cell electrolyzers.

It is obviously important that precautions be taken to prohibit unwanted fluid and/or gaseous leakage at, for example, points of mechanical connection between cell components, since otherwise the full advantages of the permselective membranes are lost. To this end, various supporting structures have been proposed; among which might be mentioned those exemplified in U.S. Pat. Nos. 3,875,040, 3,926,770, and 4,017,375. While generally efficacious in terms of support or stabilizing capabilities, the ability to disassemble internal components (e.g., individual cells) of a plural cell electrolyzer is somewhat hampered by virtue of cumbersome design.

A particularly advantageous support structure for a plural cell electrolyzer is disclosed in our co-pending application, Ser. No. 866,157, filed Dec. 30, 1977, now U.S. Pat. No. 4,129,495, entitled SUPPORT STRUCTURE FOR PLURAL CELL ELECTROLYZER, incorporated herein by reference and relied upon. It is with particular reference to the support structure of that application that the present invention for disassembly of a plural cell electrolyzer is best employed.

Because of the lack of a simple and efficient method and apparatus for the disassembly of, most preferably, internal components of a plural cell electrolyzer, the need now exists to provide the same.

SUMMARY OF THE INVENTION

In accordance with the foregoing, it is a primary object of the present invention to provide an apparatus for the simple and efficient disassembly of a plural cell electrolyzer.

Another object of the present invention is to provide an apparatus for the removal of internal components (e.g., individual cells) from a plural cell electrolyzer.

Still a further object of the present invention is to provide an assembly, including a cell frame transfer cart, for the removal of internal components of a plural cell electrolyzer.

Yet another object of the present invention is to provide a method for the efficient removal of internal components of a plural cell electrolyzer.

In accordance with the foregoing objects of the present invention, it has now been determined that a particularly efficient assembly for removal of internal components of a plural cell electrolyzer includes a cell frame transfer cart for displacement of a segment of a plural cell electrolyzer, which transfer cart is comprised of main and secondary platforms, a vertical displacement member intermediate the platforms, and a support member for both supporting the main platform and for permitting horizontal displacement of a selected segment of a plural cell electrolyzer when the vertical displacement member is actuated. In a particularly preferred embodiment, the vertical displacement member is comprised of a plurality of air-actuated bladder members, while the support member is comprised of a plurality of air bearings. The bladder members are, most preferably, disposed in mutually overlapping sets wherein the centerline of a first set passes at least tangent to the load bearing areas of adjacent sets, and further wherein each air bearing supports, within its respective load bearing area, a corresponding air-actuated bladder.

The assembly of the present invention also incorporates, in addition to the aforementioned transfer cart, a modularization member for stabilizing segments of the electrolyzer on opposing sides of that segment selected for removal, and a pair of lifting bars which include upturned lip portions for cooperating with a mating notch in each of the cell frames to be removed. The modularization member, in a preferred embodiment, consists of a stabilizing plate having apertures therein for receiving grip pins inserted through the plate into the cell frame members.

A method for effectuating removal of a selected segment of a plural cell electrolyzer is comprised, in its most essential aspects, of the steps of modularizing the segments bounding that to be removed, vertically lifting a portion of the electrolyzer, and thence removing the selected segment therefrom. The lifting step includes the vertical lifting of one of the modularized segments, whereby the same may be horizontally displaced by moving the cart member on its supporting air bearings.

Yet other objects and advantages of the present invention will become apparent to the skilled artisan upon examination of the following detailed description thereof, taken in conjunction with the Figures of Drawing; wherein:

DETAILED DESCRIPTION OF THE INVENTION

The present invention relates, generally, to a method and apparatus for removing a portion of a multi-cell electrolyzer, and most particularly to removal of internal components thereof. In this regard, the method and apparatus of the present invention have been designed with a particular eye toward taking full advantage of the cell support structure disclosed in our co-pending application, Ser. No. 866,157, filed Dec. 30, 1977, entitled SUPPORT STRUCTURE FOR PLURAL CELL ELECTROLYZER.

To capsulize the most important aspects of the support structure of application Ser. No. 866,157, there are provided a plurality of longitudinal tension bar assemblies which compressively retain the individual cell members comprising the electrolyzer in proper face-to-face orientation, and diagonal tie bar assemblies which restrain the electrolyzer cells in a substantially vertical orientation. The electrolyzer is borne upon a sleeper assembly which, amongst other things, provides vertical displacement of the electrolyzer from the supporting floor.

The transfer cart of the present invention is adapted to capitalize on this support structure detail. That is, the transfer cart of the present invention is designed to be inserted between the sleeper members, which support the electrolyzer, to a position subadjacent the cells to be removed. The transfer cart performs two primary functions in this regard; those being the ability to vertically displace a portion of the electrolyzer adjacent the segment to be removed, and also allow for horizontal movement of the supported or displaced portions. Vertical displacement is achieved by means of, preferably, a plurality of expandable bladders, while any horizontal movement of the supported segments of the electrolyzer is facilitated by a plurality of air bearings which support the transfer cart itself.

In order to more fully elucidate upon the various objects and advantages of the present invention, the following detailed description will be given in terms of certain preferred embodiments thereof. However, the same are intended to be illustrative only, and not limitative.

Figures 1, 5, 6:
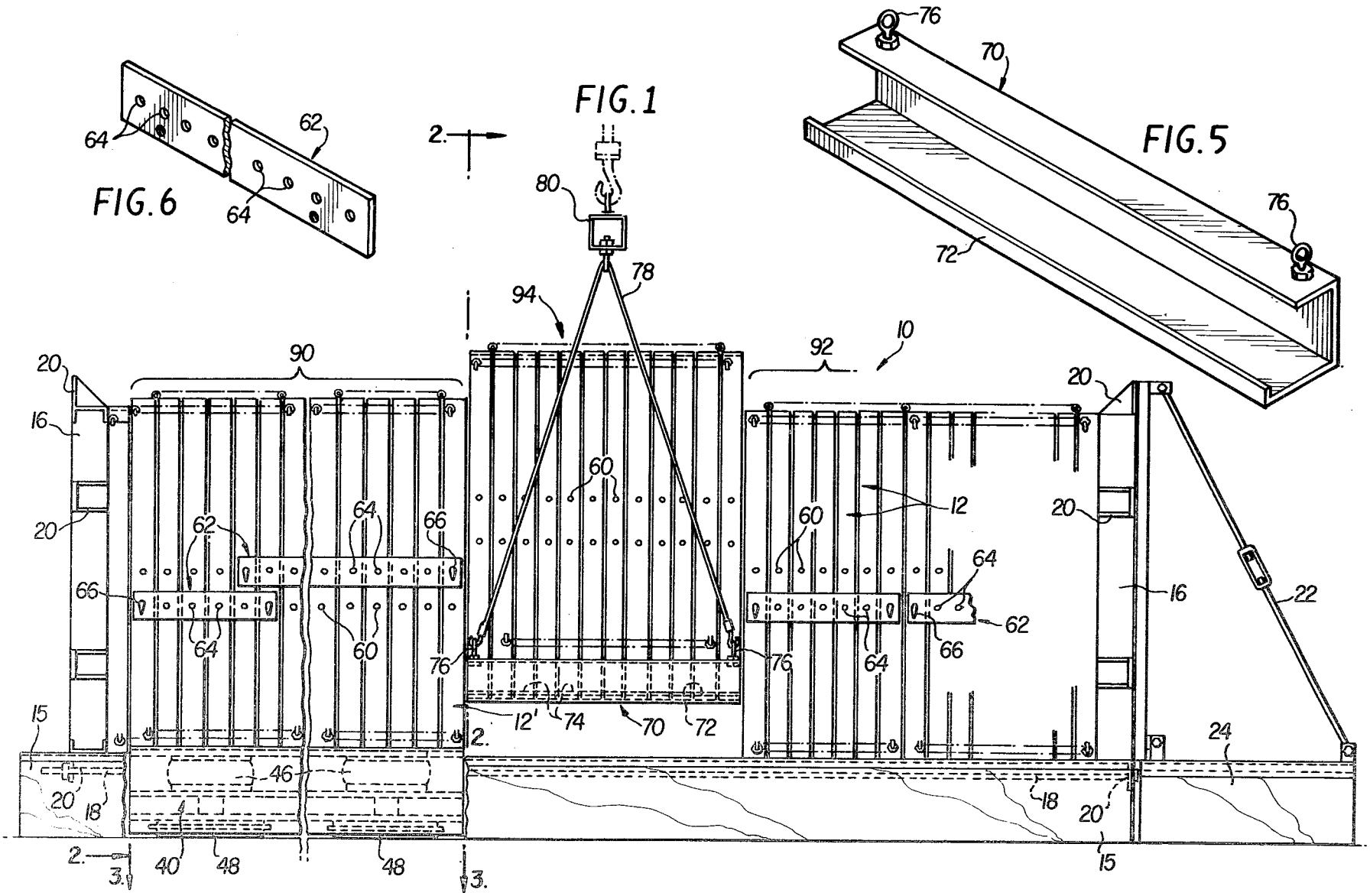
FIG. 1 is a side elevation view of a multi-cell electrolyzer showing a lifting device for removing a segment of the electrolyzer, together with a transfer cart for raising a segment of the electrolyzer from the electrolyzer supports.
FIG. 5 is a perspective view of a lifting member which forms part of a removal assembly in accordance with the present invention; and, FIG. 6 is a perspective view of a grip bar which forms a portion of the removal assembly of the present invention.

An electrolyzer, denoted generally as 10 in FIG. 1, is shown as comprised of a plurality of individual cell units 12 which are disposed in serial relationship in face-to-face contact, as is conventional in, e.g., bipolar permselective membrane electrolyzers. The cells 12 are, therefore, themselves internally comprised of a membrane separating an anode and cathode (not shown); and, externally, include various feed and recovery hoses, designated generally as 13 in FIG. 2, and intercell connectors 14 for mechanical connection and electrical communication.

Figure 2:
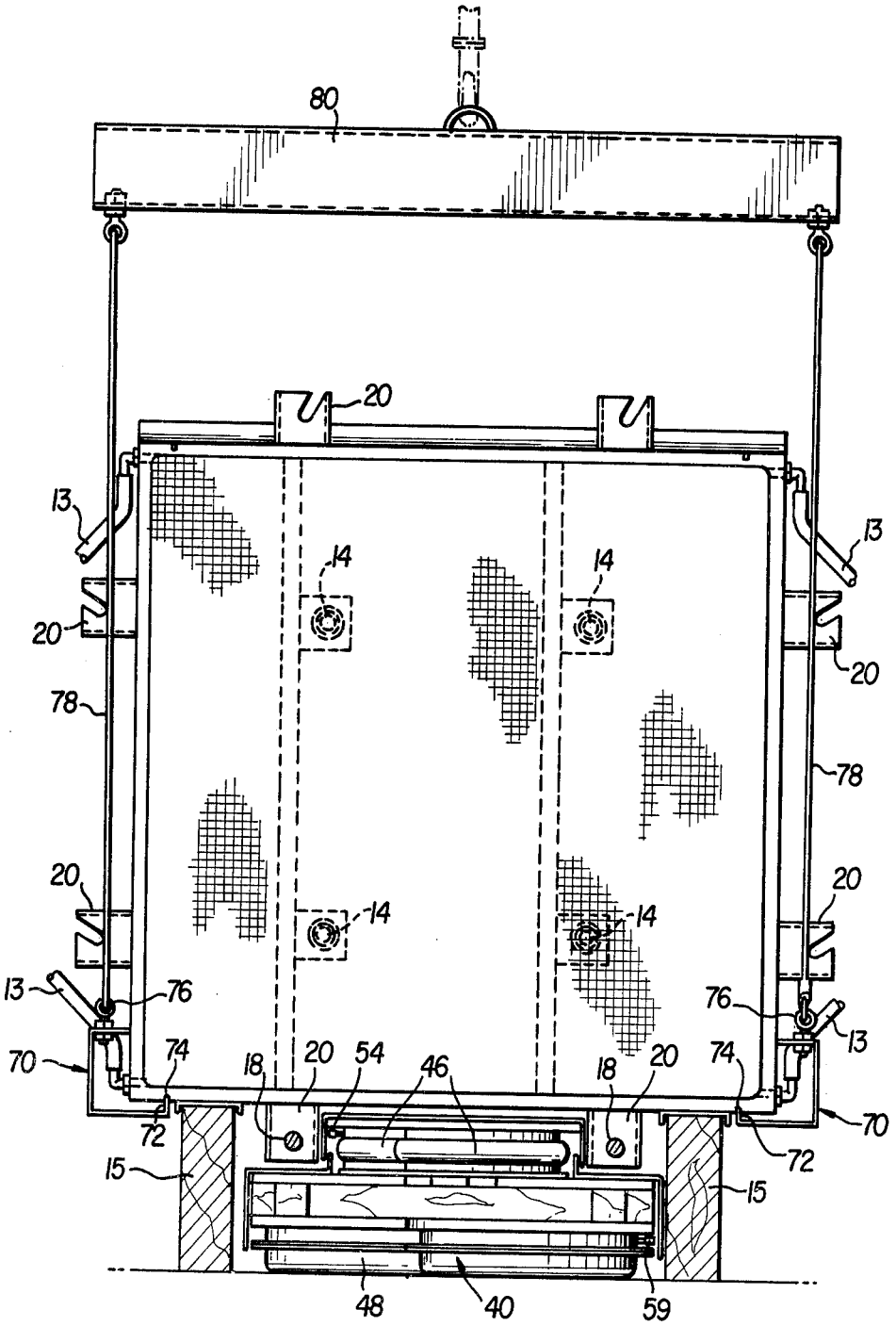
FIG. 2 is a transverse sectional view through the electrolyzer, taken substantially along the line 2—2 of FIG. 1, but showing the cells resting on the support.

The electrolyzer 10 is borne upon a pair of sleepers 15, best viewed in FIG. 2, which not only support the electrolyzer but also space the same from the floor. The sleepers 15 are illustrated to be fabricated from wood, however, any other material which possesses suitable strength, rigidity, and chemical resistance to the environment surrounding the electrolyzer may be equally well employed.

The cells 12 are disposed between opposing, terminal end frame members 16 which, in combination with longitudinal tension bar members 18, provide a retaining compressive force on the cells. For the sake of clarity, only the tension bar members 18 disposed beneath the electrolyzer 10 are shown; however, prior to disassembly of the electrolyzer, all of the tension bar assemblies will be affixed between the end frame members 16 by means of a plurality of ears or hangers 20, best shown in FIG. 2. A restraining force, which is necessary to insure a substantially vertical orientation for the cells 12, is provided by a diagonal tie bar assembly 22 secured between one of the end frame members 16 and horizontal extensions 24 of the sleeper members 15.

Figure 3:
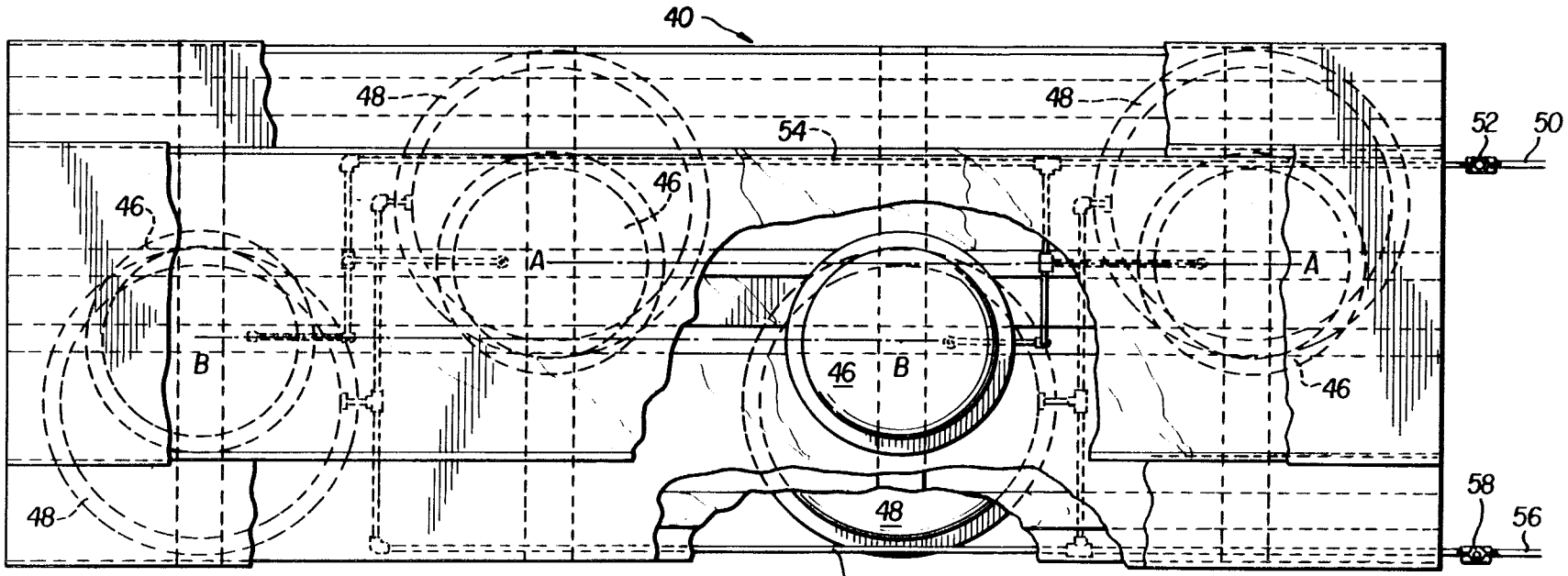
FIG. 3 is a plan view of the transfer cart of the present invention, taken substantially along the line 3—3 of FIG. 1.
Figure 4:
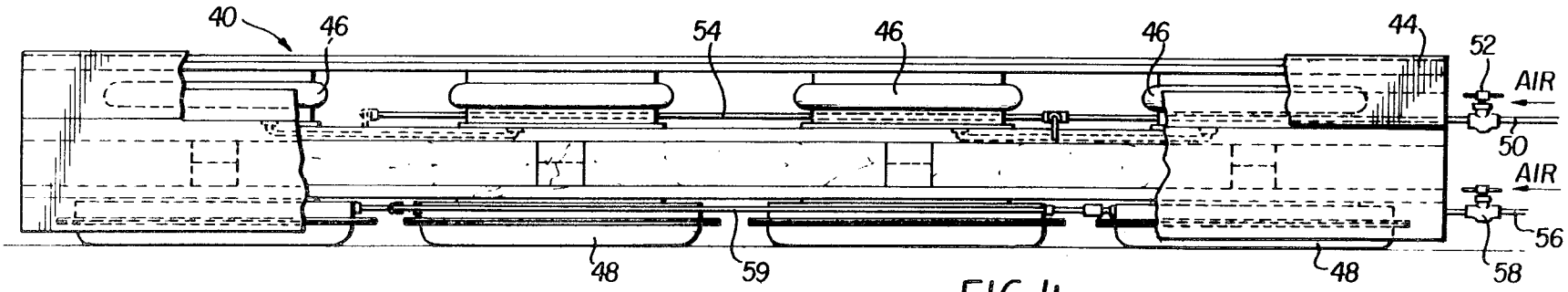
FIG. 4 is a side elevation view of the transfer cart of the present invention.

The transfer cart 40 of the present invention, best viewed in FIGS. 3 and 4, is comprised of a main platform 42 and a secondary platform 44. Intermediate these two platforms are a plurality of air-actuated, expandable bladder means 46. Supporting the main platform 42 are a plurality of, preferably, air bearings 48. Air for actuating bladder members 46 is admitted via a line 50; admission of air to the bladder members being regulated by a valve member 52. A common flow path 54 interconnects the bladder members 46 in order that each is actuated upon admission of air through the valve 52. In a similar fashion, air for operation of the air bearings 48 is delivered via a line 56 and regulated by means of a valve 58. Again, a common flow path 59 is provided between the air bearings 48 such that each receives the requisite air flow upon appropriate manipulation of valve member 58.

As shown in FIG. 3, the vertical displacement or air bladder members 46 are disposed in mutually overlapping sets wherein the centerline of a first set, A—A, is at least tangent to, or preferably overlaps, the load bearing areas of the adjacent set(s), denoted B—B. While only two such sets of bladder members are illustrated, obviously other arrangements might equally well be employed within the scope of the present invention. That fact notwithstanding, the overlapping arrangement provides a more uniform distribution of weight across the secondary platform 44.

The air bearing members 48 are similarly disposed in mutually overlapping sets. Additionally, for ease of movement when the cart is loaded, it is highly preferable that each of the bladder members 46 is disposed above the load bearing area of a corresponding air bearing 48.

Both the air bladder members 46 and air bearing members 48 are of a conventional design, and need no detailed explanation herein. Suffice it to say that the air bearings 48 might be those manufactured by Rolair System Inc., under a designation Model # 18ST, while the expandable bladder members 46 might conveniently be those manufactured by the Firestone Company, as Airstroke Actuator, catalog # 13-STD.

The overall dimensions of the transfer cart 40 are such that, prior to actuation of the bladder members 46, the cart will fit beneath the electrolyzer 10 and between the sleepers 15, as best viewed in FIG. 2. The cart 40 may, accordingly, be freely inserted beneath the electrolyzer 10 to a position subadjacent a segment selected to be removed, as shown in FIG. 1. In order to remove a segment of the electrolyzer, it is first necessary to relax the compressive force exerted by the tension bar assemblies 18. While FIGS. 1 and 2 show all of the tension bar members 18 removed, save for those beneath the electrolyzer 10, it is possible to remove a portion of the electrolyzer having only first removed the tension bars located along the top side. In either event, however, the individual cells adjacent that section selected for removal must be stabilized as the retaining force normally provided by longitudinal tension bars 18 is no longer present.

To stabilize those sections adjacent that to be removed from the electrolyzer, each of the cell frames 12 is formed with holes 60, to present at least two sets as shown in FIG. 1. A cell grip bar 62, shown in FIG. 6, is also formed with a row of apertures 64, the spacing between apertures 64 corresponding to the spacing between the holes 60 in adjacent cell 12. Expandable grip pins 66, such as those marketed as "Expando-Grip-Pin" by the Adjustable Bushing Corporation, are inserted through the apertures 64 into the holes 60 to securely fasten the grip bar 62 to a series of cells 12. The grip bar 62 may be any convenient length to encompass, for example, 6 or 9 or 12 cells. It is also possible to overlap two grip bars, as shown in FIG. 1, to allow for the stabilization of a greater number of cells.

In order to remove a selected segment of the electrolyzer 10, a pair of lifting bars 70, shown in FIG. 5, are employed. Each lifting bar 70 includes an upturned lip portion 72 which cooperates with notches 74 formed in each of the cell frames, as best viewed in FIG. 2. A pair of lifting eyes 76 are located on the lifting bars 70 for attachment to lifting cables 78. An overhead hoist 80 or similar structure may be utilized to remove the selected segment of the electrolyzer. The lifting bar 70 may be of any desired length, corresponding to the number of cells to be removed.

Implementation of the method for removal of a portion of the electrolyzer 10 is achieved by first placing the cell frame transfer cart 40 beneath the electrolyzer as shown in FIG. 1. As all of the tension bar assemblies 18 have been loosened, and at least those on the top side of the electrolyzer 10 removed, it is necessary to modularize the segments 90 and 92 bounding either side of the selected segment 94 which is to be removed, as noted above, whereby the segments 90 and 92 are stabilized. The expandable bladders 46 are actuated by the controlled admission of air via line 50 through valve 52, thereby causing the secondary platform 44 to displace all of the cells contained in the segment 90 (up to, and including, cell 12') off of the sleeper assemblies 15. The feed and recovery hoses, designated generally as 13 in FIG. 2, are disconnected from the cells which constitute the segment 94 selected for removal. The upturned lip 72 of lifting bar 70 is caused to engage the notch section 74 in each of the cells in segment 94 and, by any convenient lifting means (such as an overhead hoist), the portion 94 may be easily removed from the electrolyzer 10. As noted above, the length of lifting bar 70 may be appropriately varied to encompass the number of cells selected for removal.

Prior to physical removal of the portion 94, it is necessary to provide horizontal displacement of the stabilized segment 90 of electrolyzer 10 adjacent that segment selected for removal. For example, in order for an operator to gain access to the internal components of the electrolyzer 10 to manually remove the same, it is necessary to displace the segment 90 sufficiently away from the segment 94 that physical access may be achieved. Horizontal displacement of segment 90 also guards against damage to the cells bounding the line dividing the various segments (e.g., 90, 94) during subsequent removal. When the bladder members 46 are actuated, only the segment 90 will be lifted from the sleeper assemblies 15, while the cells to the right of 12' will remain resting on the sleeper supports. Owing to the ease of mobility provided by way of air bearing members 48, the segment 90 may be horizontally displaced while supported on the transfer cart 40. Due to the flexibility of interconnecting hoses, this displacement is readily performed.

From the foregoing description, it is apparent that the present invention provides a method and apparatus which allows simple and efficient access to internal components of a multi-cell electrolyzer. Also, disassembly thereof is readily facilitated.

While the invention has now been described in terms of certain preferred embodiments, the skilled artisan will appreciate that various changes, modifications, omissions, and substitutions may be made without departing from the spirit thereof. Accordingly, it is intended that the scope of the present invention be limited solely by that of the following claims.

What is claimed is:

1. A cell frame transfer cart for vertical and horizontal displacement of a segment of a plural cell electrolyzer comprising:

(a) a main platform;

(b) a secondary platform;

(c) vertical displacement means intermediate said main platform and said secondary platform comprising a plurality of air-actuated bladder members disposed in mutually overlapping sets, wherein the centerline of a first set passes at least tangent to the load-bearing area of the adjacent set; and, (d) support means for supporting said main platform and for permitting horizontal displacement of a selected segment of a plural cell electrolyzer when said vertical displacement means are actuated.

2. The transfer cart of claim 1, wherein there are four of said bladder members disposed in two of said mutually overlapping sets.

3. The transfer cart of claim 1, wherein said support means comprises a plurality of air bearings.

4. The transfer cart of claim 1, wherein said support means comprises a plurality of air bearings and wherein each of said bladder members is supported withing the load-bearing area of a corresponding air bearing.

5. In combination with a plural cell electrolyzer, the transfer cart of claim 4.

6. An assembly for removal of a segment of a plural cell electrolyzer, comprising (a) the transfer cart of claim 4;

(b) modularization means for stabilizing segments of a plural cell electrolyzer on opposing sides of the segment selected for removal; and, (c) removal means for removal of a selected segment of said electrolyzer.

7. The assembly of claim 6, wherein said modularization means comprises:

(a) apertures in each of the cell frames constituting said electrolyzer;

(b) grip bars having spaced apertures, wherein the spacing between apertures in said bars corresponds to that between apertures in adjacent cell frames; and, (c) grip pins inserted through the apertures in said bars into the apertures in said cell frames.

8. The assembly of claim 7, wherein said removal means comprises:

(a) a pair of lifting bars, each of which has a length corresponding to the length of said selected segment and each of which includes an upturned lip; and, (b) notches in each cell within said selected segment for receiving said lip.

* * * * *